United States Patent [19]

Pritulsky

[11] 4,264,117

[45] Apr. 28, 1981

[54] SOCKET FOR WEDGE BASE INCANDESCENT LAMP

[75] Inventor: James Pritulsky, Harrisburg, Pa.

[73] Assignee: AMP Incorporated, Harrisburg, Pa.

[21] Appl. No.: 106,191

[22] Filed: Dec. 21, 1979

[51] Int. Cl.[3] ..... H01R 4/24

[52] U.S. Cl. ..... 339/97 L; 339/125 L; 339/176 L

[58] Field of Search ..... 339/97 R, 97 L, 97 P, 339/98, 99 R, 99 L, 119 L, 125 L, 176 L, 191 L, 195 L, 206 L, 210 T, 17 D

[56] References Cited

U.S. PATENT DOCUMENTS

| | | | |
|---|---|---|---|
| 2,825,038 | 2/1958 | Woofter | 339/17 |
| 2,965,875 | 12/1960 | Danesi | 339/97 L |
| 3,760,335 | 9/1973 | Roberts | 339/99 R |
| 3,798,588 | 3/1974 | Howe et al. | 339/127 |
| 3,871,738 | 3/1975 | Dechelette | 339/256 C |
| 3,936,131 | 2/1976 | Durand | 339/176 L |
| 3,950,061 | 4/1976 | Kausen | 339/176 L |
| 3,955,873 | 5/1976 | Peterson | 339/99 R |
| 4,114,972 | 9/1978 | Kraus et al. | 339/176 L |
| 4,159,158 | 6/1979 | Weidler | 339/97 P |
| 4,181,390 | 1/1980 | Aizawa | 339/176 L |

FOREIGN PATENT DOCUMENTS

| | | | |
|---|---|---|---|
| 1326008 | 8/1973 | United Kingdom | 339/176 L |

*Primary Examiner*—John McQuade
*Attorney, Agent, or Firm*—Frederick W. Raring

[57] ABSTRACT

A socket assembly for an incandescent lamp having a glass wedge base comprises a housing having a bulb-receiving face, a rear face, a bulb-receiving cavity extending into the bulb-receiving face, and a pair of passageways extending into the rear face and communicating with the bulb-receiving cavity. A stamped and formed contact terminal is inserted in each of the cavities, each terminal having a socket portion disposed in the bulb-receiving cavity and a wire-contacting portion proximate to the rear face. The wire contacting portion has a wire-receiving slot therein and an integral retaining finger extending from the rear face across the entrance to the wire-receiving slot of each terminal. In use, the housing is mounted on a panel having a hole therein which receives a bulb. Wires are connected to the terminals by first flexing the retaining fingers and placing the wires in the entrance portions of the wire-receiving slots of the terminals. Thereafter, the wires are pushed into the wire-contacting portions of the slots to connect the wires to the terminals. The bulb can be inserted through the panel opening and into the terminals in the housing.

6 Claims, 4 Drawing Figures

SOCKET FOR WEDGE BASE INCANDESCENT LAMP

FIELD OF THE INVENTION

This invention relates to sockets for incandescent lamps of the type which have a glass base against which the filament wires are disposed.

BACKGROUND OF THE INVENTION

A commonly used type of small incandescent lamp comprises a glass envelope and a glass base which is integral with the envelope. The filament wires extend through, and are embedded in, the envelope and have terminal end portions disposed against side surfaces of the base of the bulb. Receptacle sockets for this type of bulb have a pair of terminals in side-by-side relationship, each terminal having spaced-apart spring arms which receive the base of the bulb and electrically contact the terminal end portions of the wires. The lead wires extending from the receptacle socket are generally soldered to the terminals. Bulbs of this type are widely used in the manufacture of amusement devices, such as pinball machines, which have a large number of bulbs mounted in a panel board. Amusement devices of this type are frequently manufactured by mounting the lamp sockets, or bulb sockets, on the panel and then lacing the wires along the desired circuit paths from the power source to the terminals in the socket assemblies and soldering the wires to the terminals.

The present invention is directed to the achievement of an improved socket assembly which will eliminate the need for soldering wires to the terminals in the socket and which will greatly simplify the manufacture of devices, such as pinball machines, which require a large number of small incandescent lamps on a panel. A socket assembly, in accordance with the invention, comprises an insulating housing having a bulb-receiving face, a rear wire-receiving face, and a bulb-receiving cavity extending into the bulb-receiving face. Two side-by-side passageways extend into the rear face and communicate with the bulb-receiving cavity. Each passageway has a contact terminal thereon, each terminal having a wire connecting portion at the rearward end thereof and a receptacle portion which is disposed in the bulb-receiving cavity. The wire-connecting portion of each terminal has a wire-receiving slot means therein which has enlarged entrance and a reduced width inner end portion. The housing has integral flexible retaining fingers extending from the rear face and across the entrance portions of the slots in the terminals. In use, the housings are mounted on the panel board at the desired locations and the wires required for the sockets are laced around the panel board and positioned in the entrance portions of the terminal slots by flexing the retaining fingers away from their associated terminals and locating the wires in the slots. When the retaining fingers return to their normal portions, they will maintain the wires in their proper positions relative to the terminals so that the wiring of the panel can be inspected prior to movement of the wires into the slots in the terminals. Insertion of the wire into the wire-contacting portions of the slots can be accomplished by means of a suitable hand tool.

DRAWINGS

FIG. 1 is an exploded perspective view of a lamp socket assembly in accordance with the invention, showing a wedge base incandescent lamp exploded from the bulb-receiving face of the socket housing.

FIG. 2 is a perspective view showing a lamp socket assembly mounted on a panel and illustrating the manner of positioning the wires in the socket assembly and establishing contact with the wires.

FIG. 3 is a view taken along the lines 3—3 of FIG. 2.

FIG. 4 is a fragmentary perspective view of a panel member having a plurality of socket assemblies mounted thereon illustrating alternative mounting means for the socket assemblies.

DESCRIPTION OF THE DRAWINGS

A socket assembly 2 in accordance with the invention serves to connect insulated wires 4, 4' to the terminal end portions 6, 6' of the filament wire in an incandescent lamp or bulb 8. The bulb 8 has a generally cylindrical envelope 10 and an integral glass base 12 which is generally rectangular, but which has an enlarged central cylindrical section 13. The terminal end portions 6, 6' of the filament wire are embedded in and extend through the glass base and are disposed against side surface portions 14 of the base 12 on each side of the central cylindrical portion 13.

The socket assembly 2 comprises a housing 16 of suitable molded thermoplastic material, such as polyester, having a bulb-receiving face 18, a rear face 20, and a bulb-receiving cavity 22 extending inwardly from the face 18. Two side-by-side passageways 24, 24' extend into the rear face 20 to the bulb-receiving cavity 22, a central barrier 26 being provided on the rear face 20 between these passageways to separate the contact terminals 28, 28' from each other.

Figure 1:
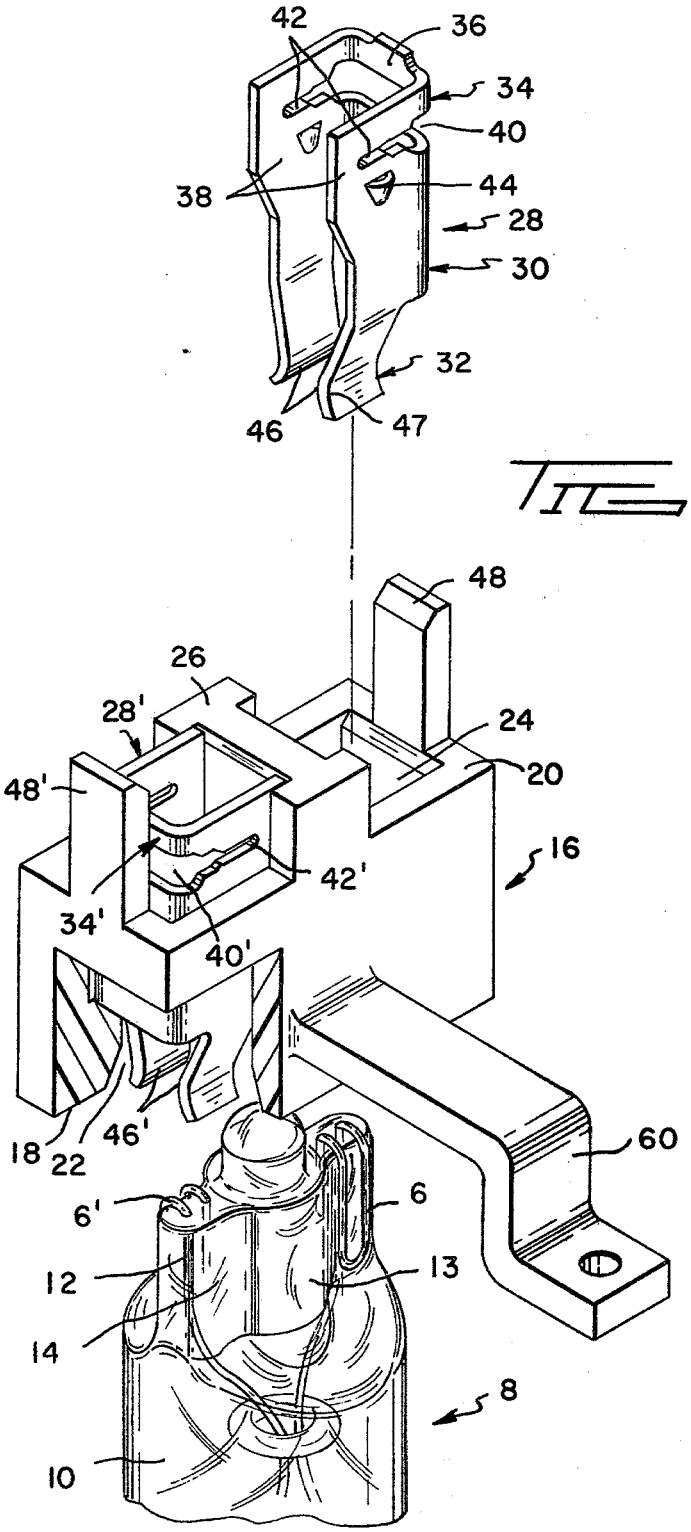

The terminal 28, 28' are identical to each other so that a description of the terminal 28 will suffice for both. The terminal 28 is of stamped and formed conductive metal, such as brass, and has a forward bulb-receiving end 32, an intermediate portion 30, and a wire-connecting end 34. The terminal comprises a web 36 which extends from the end 34 partially along the length of the terminal and sidewalls 38 which extend from the side edges of the web. A pair of wire-contacting slots 42 are provided in the sidewalls and extend towards the web to an enlarged entrance portion 40 which has a diameter substantially greater than the diameter of the wire for which the terminal is intended. The bulb-receiving end 32 comprises a pair of spring arms 46 which are extensions of the sidewalls 38 and which are inclined towards each other and have their end portions reversely bent, as shown at 47. The terminals are assembled to the housing by simply inserting them into the passageways 24, 24' with the web portions 36 remote from each other. The terminals should have a snug fit in the passageways and lances 44 are provided on the sidewalls 36 to ensure their retention in the housing.

A pair of wire-retaining fingers 48, 48' are integral with the rear face 20 of the housing and extend from the rear face 20 past the entrance portions 40, 40' of the terminals. These fingers are somewhat flexible as illustrated in FIG. 3, so that they can be moved away from their respective terminals to permit positioning of a wire in the entrance portions of the terminals.

Figure 2:
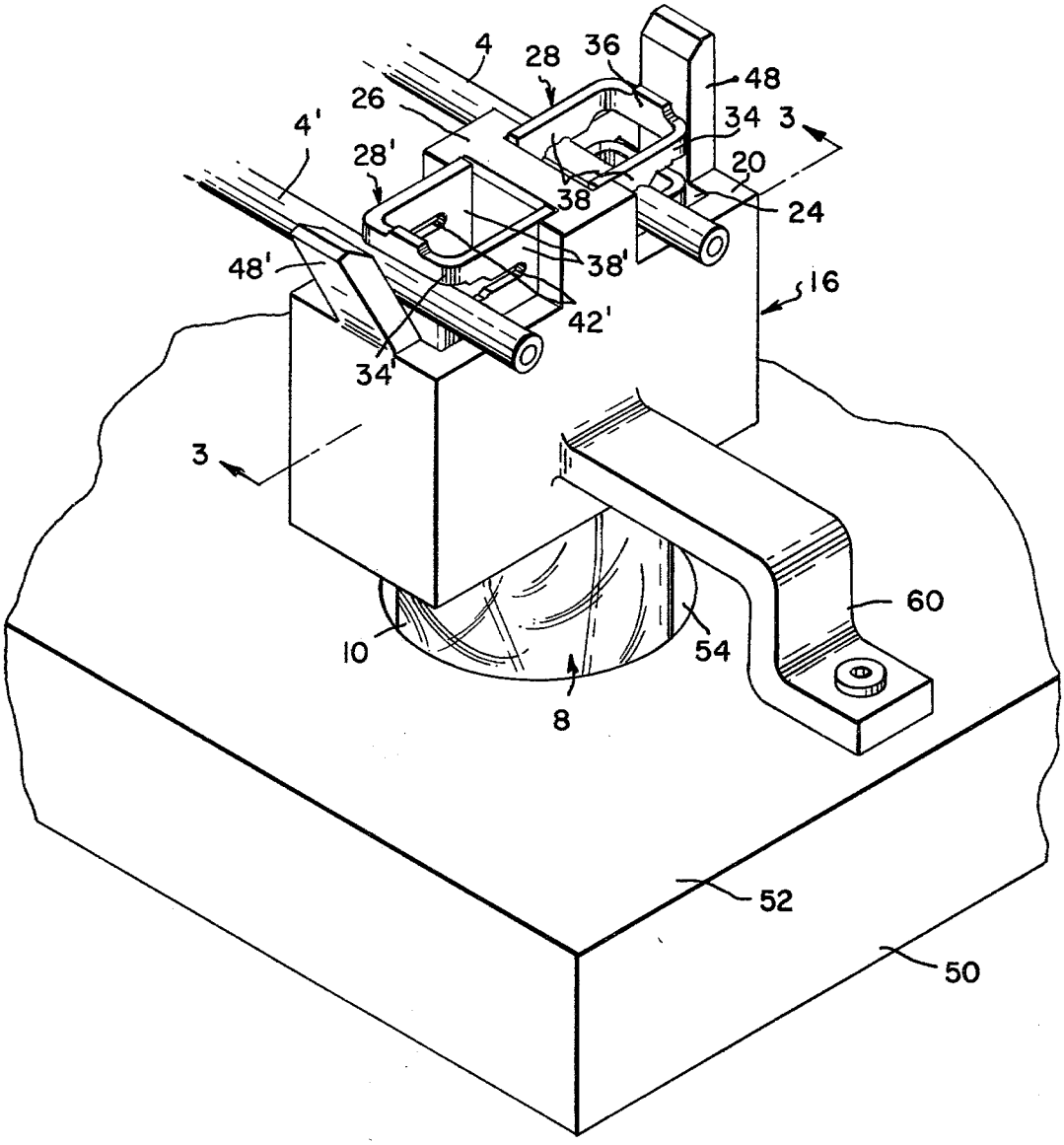

The housings shown have integral mounting arms as shown at 60 in FIG. 2, extending from their external surfaces to permit their being mounted on a surface 52 of a panel member 50. In use, and when a plurality of incandescent bulbs are to be mounted on the panel member adjacent to openings 54 thereon, the housings are secured to the panel by fasteners at the appropriate locations. Thereafter, the wires 4, 4' are assembled temporarily to the housings by flexing the retaining fingers 48, 48' away from their associated terminals, positioning the wires in the entrance portions of the terminals, and permitting the fingers to return to their normal positions. The wiring paths can thus be inspected prior to establishment of the permanent electrical connections between the wires and the terminals. After such inspection, The technician forms the permanent connections by simply inserting each wire fully into the wire-receiving slot 42 of the terminal with which it is associated. During an insertion, the edges of the slots penetrate the insulation of the wire and establish contact. Insertion can be carried out by a suitable specialized hand tool or, if desired, by multiple use tooling, such as a pair of pliers.

Figure 3:
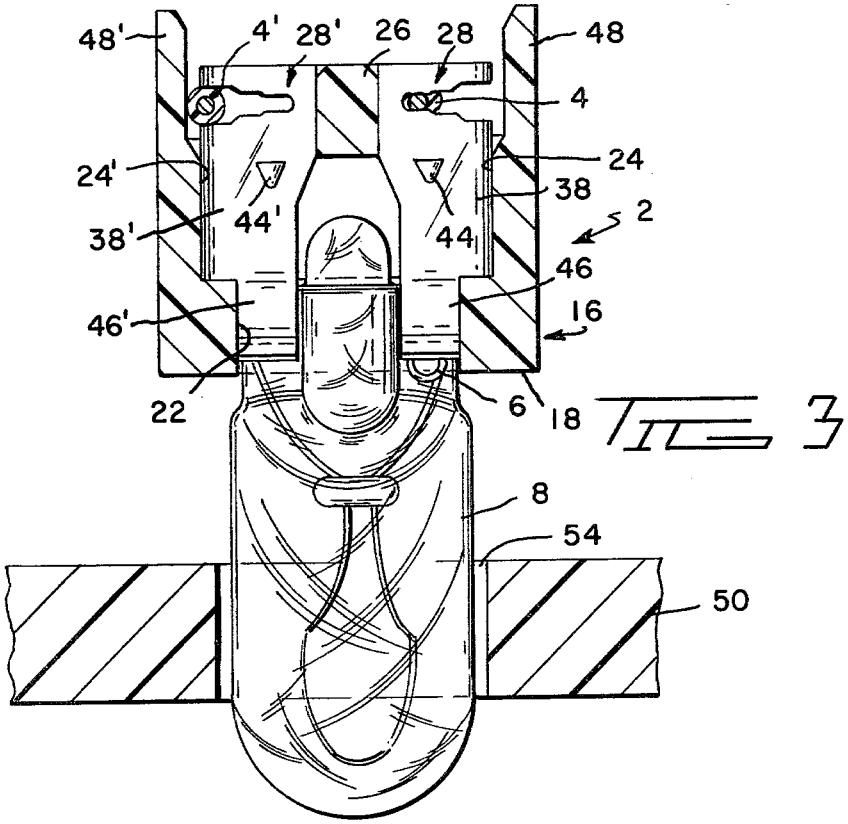
Figure 4:
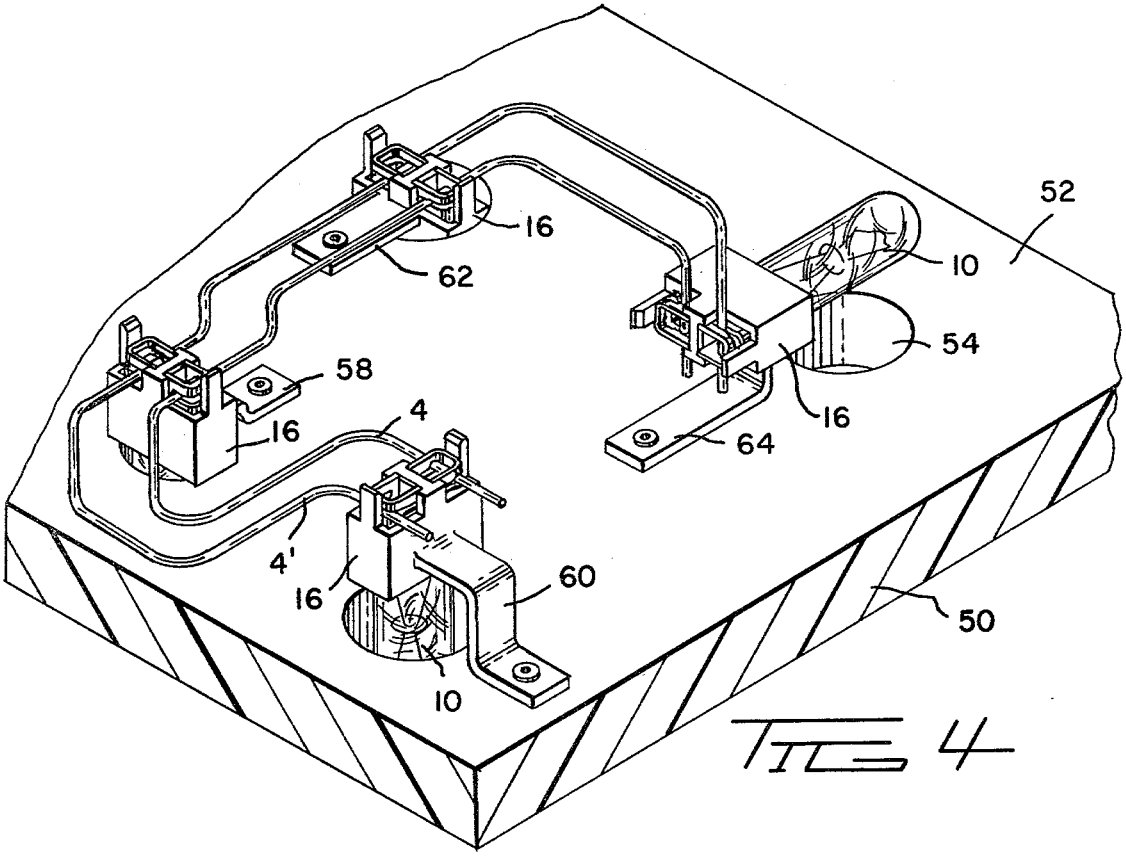

FIG. 4 illustrates several alternatives to the mounting member 60 shown in FIG. 3. The mounting arm 60 supports the housing 16 above the surface 52 of the panel board so that the bulb 8 extends partially into the opening 54 in the panel. FIG. 4 also shows a mounting arm 58 which supports the housing with its face 18 against the surface 52, a mounting member 62 which supports the housing such that the housing is disposed in an opening in the panel, and a supporting member 64 which supports the housing in a manner such that the bulb is spaced from the opening in the panel member.

As previously mentioned, the use of socket assemblies, in accordance with the invention, is particularly advantageous in the manufacture of devices, such as pinball amusement games which are band wired by a technician during the manufacturing process. The wires can readily be placed in their proper positions on the panel and adjacent to predetermined terminals in the socket housings by the technician, and he need not be concerned with connecting the wires to the terminals while he is assembling the wires to the panel. Thereafter, the wires can be connected to the terminals with a simple operation of a hand tool.

I claim:

1. A lamp socket assembly intended for reception of a lamp bulb of the type having a generally rectangular glass base with the conductors from the lamp filament extending through said base and with terminal end portions of said conductors disposed against side surface portions of said base, said socket assembly comprising:

an insulating housing having a bulb-receiving face and a rear wire-receiving face, a bulb-receiving cavity extending into said bulb-receiving face, a pair of side-by-side terminal-receiving passageways extending into said rear face, said passageways communicating with said bulb-receiving cavity, a pair of stamped and formed contact terminals, each of said terminals having an intermediate portion which is mounted in one of said passageways, a bulb-receiving end which is disposed in said bulb-receiving cavity, and a wire-receiving end which is proximate to said wire-receiving face, each of said terminals having wire-receiving slot means therein proximate to said rear face of said housing, said slot means having an enlarged entrance portions and a reduced width wire contacting portion and, wire-retaining means integral with said rear face of said housing, said wire-retaining means being effective to retain wires in said entrance portions of each of said wire-receiving slots whereby, upon mounting said socket assembly on a support such as a panel, wires can be connected to said terminals by locating said wires in said entrance portions of said terminals and thereafter moving said wires into said wire-contacting portions of said wire-receiving slot means.

2. A lamp socket assembly as set forth in claim 1, said wire-receiving slot means extending parallel to said rear face of said housing.

3. A lamp socket assembly as set forth in claim 2, said wire-receiving end of each of said terminals extending beyond said rear face of said housing, said wire-retaining means comprising a flexible finger for each of said terminals, each of said fingers being normally against its respective terminal and extending past said entrance portion of its respective terminal.

4. A lamp socket assembly intended for reception of a lamp bulb of the type having a generally rectangular glass lamp base with the conductors from the lamp filament extending through, and being embedded in, said base and with terminal end portions of said conductors extending along side surfaces of said base, said socket assembly comprising:

an insulating housing having a bulb-receiving face and a rear wire-receiving face, a bulb-receiving cavity extending into said bulb-receiving face, a pair of side-by-side terminal-receiving passageways extending into said rear face, said passageways communicating with said bulb-receiving cavity, a pair of stamped and formed contact terminals, each of said terminals having a wire-receiving end and a bulb-receiving end, each of said terminals comprising a one-piece stamped and formed part having a web, sidewalls extending from side edges of said web, and a pair of spring arms, said web and said sidewalls extending from said wire-receiving end partially along the length of said terminals, said spring arms being extensions of said sidewalls, a wire-admitting opening in said web adjacent to said wire-receiving end and a wire-receiving slot in each of said sidewalls extending from said opening away from said web, each of said terminals having an intermediate portion thereof received in one of said passageways with said spring arms disposed in said bulb-receiving cavity and with said wire-receiving end extending beyond said rear face of said housing, a pair of flexible wire-retaining fingers extending from said rear face of said housing, each of said fingers extending across the external surface of one of said terminals and across said wire-admitting opening of said one terminal whereby, wires can be connected to said terminals by flexing said fingers away from said webs of said terminals, placing said wires in said openings and thereafter moving said wires laterally of their axes and into said slots.

5. A lamp socket assembly as set forth in claim 4, said terminals being oriented in said housing with said slots extending towards each other.

6. A lamp socket assembly as set forth in claim 5, said housing having mounting means integral therewith for mounting said housing on a panel.

* * * * *